US007325495B1

(12) United States Patent
Giandomenico et al.

(10) Patent No.: US 7,325,495 B1
(45) Date of Patent: Feb. 5, 2008

(54) HOT GAS DEPLOYMENT DEVICES

(76) Inventors: Thomas Giandomenico, 843 E. San Bernardino Rd., Covina, CA (US) 91723; Thomas Anthony Giandomenico, 843 E. San Bernardino Rd., Covina, CA (US) 91723

( * ) Notice: Subject to any disclaimer, the term of this patent is extended or adjusted under 35 U.S.C. 154(b) by 0 days.

(21) Appl. No.: 11/400,858

(22) Filed: Apr. 8, 2006

Related U.S. Application Data

(60) Provisional application No. 60/670,378, filed on Apr. 11, 2005.

(51) Int. Cl.
*F42B 12/46* (2006.01)

(52) U.S. Cl. ..... 102/370; 102/368

(58) Field of Classification Search ..... 42/1.08, 42/105; 102/398, 370, 368, 482, 498
See application file for complete search history.

(56) References Cited

U.S. PATENT DOCUMENTS 3,318,033 A * 5/1967 Barr ..... 42/105
3,656,435 A * 4/1972 Barr et al. ..... 102/368
3,733,727 A * 5/1973 Jones et al. ..... 42/106
3,795,197 A * 3/1974 Levenson ..... 102/368
4,976,201 A * 12/1990 Hamilton ..... 102/323
5,515,767 A * 5/1996 Gilbert ..... 89/1.701
5,811,713 A * 9/1998 Gudgel ..... 89/1.34
6,276,085 B1 * 8/2001 Wooten et al. ..... 42/1.08
6,581,521 B1 * 6/2003 Dixon et al. ..... 102/368
6,860,052 B1 * 3/2005 Conner et al. ..... 42/1.08

OTHER PUBLICATIONS

Thomas Giandomenico, "Hot Gas Deployment Device", The Tactical Edge, Fall 2005.

* cited by examiner

*Primary Examiner*—James S. Bergin
*Assistant Examiner*—Benjamin P Lee
(74) *Attorney, Agent, or Firm*—Melanius D'Souza

(57) ABSTRACT

A hot gas deployment device for safely deploying a "hot" tear-gas canister to flush out barricaded law-resisters. The device includes an internal chamber for inserting the tear-gas canister therein, securing means to secure the canister in place during deployment, and a handle for easy operation. The chamber safely contains the hot-gases produced by the tear-gas canister to reduce the risk of causing a fire in the barricaded space. Tear-gas release orifices on the chamber's housing release the tear-gas from the chamber. One embodiment of the device includes a hollow spear for releasing the tear-gas through walls and other obstructions. Another embodiment of the device is suitable for hurling with a tear-gas grenade launcher.

20 Claims, 6 Drawing Sheets

HOT GAS DEPLOYMENT DEVICES

CROSS-REFERENCE TO RELATED APPLICATION

This application claims priority from U.S. Provisional Application No. 60/670,378 filed on Apr. 11, 2005.

FIELD OF THE INVENTION

This invention relates to devices, which can be used by law enforcement officers, for safely deploying "hot" tear-gas grenades.

BACKGROUND OF THE INVENTION

Tear-gas has long been used by law-enforcement agencies as a means for controlling unruly crowds and for flushing out barricaded law-resisters. Two types of tear-gas canisters are commonly in use: "cold-gas" and "hot-gas", which differ in the mechanism used to disperse o-chlorobenzylidenemalononitrile (CS). CS is the active ingredient in tear-gas, which irritates the mucous membranes in the eyes, nose, mouth and lungs, and causes tearing, sneezing, coughing, etc. Physically, CS is a white crystalline substance, which is usually mixed with a pyrotechnic compound in a grenade or canister for use. When used, it is generally suspended in a smoke or a fog of suspended particles. It is effective as a crowd control agent because it is an extremely severe skin and mucous membrane irritant and lacrimator, even at minute doses.

The "cold-gas" canister uses an aerosol propellant to disperse CS particles. The "hot-gas" canister uses pyrotechnics to create smoke, which retains the CS particles and delivers them to the target area. A pyrotechnic device is more effective dispersing chemical agents through smoke. A "hot-gas" canister delivers more than 20-80 grams of CS. In comparison, the delivery rate of a "cold-gas" canister is only about 4 grams of CS. Thus "hot-gas" canisters are more efficient to use for crowd control and for flushing out barricaded law-resisters than "cold-gas" canisters. Therefore, law-enforcement agencies generally prefer to use "hot-gas" canisters rather than "cold-gas" canisters in their law-enforcement activities.

However, the use of "hot-gas" canisters has inherent risks associated with the use of pyrotechnic devices. The flames and high temperatures produced by the pyrotechnic device may sometimes ignite combustible matter in its vicinity resulting in destruction of personal and real property. Thus, even though law-enforcement agencies generally prefer to use "hot-gas" canisters, they are usually circumspect in the use of "hot-gas" canisters for law-enforcement activities. To reduce the risks associated with the use of the "hot-gas", many law-enforcement agencies utilize a Hot Gas Deployment Device (HGDD), commonly called a "Burn-Safe", to help effectively mitigate the possibility of structure fires, when deploying hot gas.

A "Burn-Safe" is a container which contains the flames produced by the pyrotechnic device while allowing the CS-containing smoke to safely disperse into the target area. The typical "Burn-Safe", in-service for several years now, has gone through many metamorphoses. It initially started as a military ammunition can, within which the "hot-gas" was generated for safe dispersal of the tear-gas. It later evolved into a heavy steel cylinder with a baffling system to limit the possibilities of fire.

However, the deployment of a full size "Burn-Safe" imposes many risks on the law-enforcement officer. For example, the "Burn-Safe" is heavy and often must be manually deployed, sometimes away from safe cover. In such a situation, the officer may be exposed to hostile fire. The officer has to get relatively close to a dangerous law-resister and heave the "Burn-Safe" towards him/her.

Therefore, there is a need for an improved HGDD that is light-weight, safe, efficient, compact, and easy to use.

SUMMARY OF THE INVENTION

The present invention is directed to a HGDD which is light-weight, safe, efficient, and easy-to use in various law-enforcement situations.

In a first embodiment of the HGDD, the HGDD comprises a cylindrical housing defining an internal cylindrical chamber for axially receiving a tear-gas canister. The chamber is open at its first end and generally closed at its second end. The housing is further formed with a stick-handle for grasping the HGDD during deployment. A securing means is provided for generally holding the tear-gas canister in position within the chamber during the deployment of the tear-gas grenade. For ease of use, the stick-handle is provided on the closed end of the housing. In one aspect of the first embodiment of the HGDD, the stick-handle is hollow. In another aspect of the first embodiment of the HGDD, the housing comprises a cap-closure for the open end of the chamber. The cap-closure has an opening for inserting the threaded end of the tear-gas grenade firing mechanism (commonly referred to as the "bouchont" by law-enforcement officers) into the tear-gas canister. The cap-closure further functions as the securing means for generally holding the tear-gas canister in position within the chamber during the deployment of the tear-gas grenade. A tear-gas discharge opening is provided in the housing for releasing the tear-gas from within the chamber to the external environment of the chamber. Preferably, the tear-gas discharge opening in the housing is in the cylindrical chamber, but it could also be in the cap-closure or the closed-end of the housing.

In yet another aspect of the first embodiment of the present invention, the HGDD further includes a stick-handle extension means to extend the reach of the device to a length between 5 to 20 feet to safely reach barricaded law-resisters.

In a second embodiment of the present invention, the stick-handle is elongated to a length between 2 to 10 feet and comprises a barrier penetration means and an orifice for discharging the tear-gas inside the barricaded space. In one aspect of the second embodiment of the present invention, the orifice is located on the barrier penetration means. The HGDD further includes a tear-gas pressure relief means for releasing the tear-gas from the device if excessive gas pressure builds up in the chamber. The tear-gas pressure relief means is a pressure-distensible flexible sleeve, the flexible sleeve being sleeved over the external surface of the housing to cover the tear-gas release opening on the housing.

In a third embodiment of the present invention, the HGDD comprises a housing which defines an internal cylindrical chamber for axially receiving a tear-gas canister. The chamber is open at one end and generally closed at its second end. The housing further comprises a bucket-handle and a cap-closure for closing the open end of the chamber. The cap-closure has an opening for inserting the bouchont of the tear-gas grenade into the tear-gas canister. The housing further has a tear-gas opening for releasing the tear-gas from the chamber to the external environment. In one aspect of the second embodiment of the present invention, the bucket-handle is attached to the cap-closure. In another aspect of the third embodiment of the present invention, the housing is weight-enhanced for increased momentum when hurled during deployment. In another one aspect of the third embodiment of the present invention, thermal stand-off means are provided on the exterior of the housing to reduce the possibility of causing fires when the HGDD is deployed.

In a fourth embodiment of the present invention, the hot gas deployment device is configured for use with a shot-gun assisted tear-gas grenade launcher. The HGDD comprises a cylindrical housing defining an internal cylindrical chamber for axially receiving a tear-gas canister. The chamber is open at one end and generally closed at its second end. The outer diameter of the housing is designed for a sliding, relatively-gas-tight fit within the breech of the grenade launcher. The housing further comprises a cap-closure for closing the open end of the chamber. The cap-closure has an opening for inserting the bouchont of a tear-gas grenade into the tear-gas canister. The housing further has an opening for releasing the tear-gas from the chamber to the external environment. In one aspect of the fourth embodiment of the present invention, the housing is non-metallic, preferably of a high temperature resistant plastic, such as Delrin®.

DETAILED DESCRIPTION OF THE INVENTION

First Embodiment of the Invention

Figure 1A:
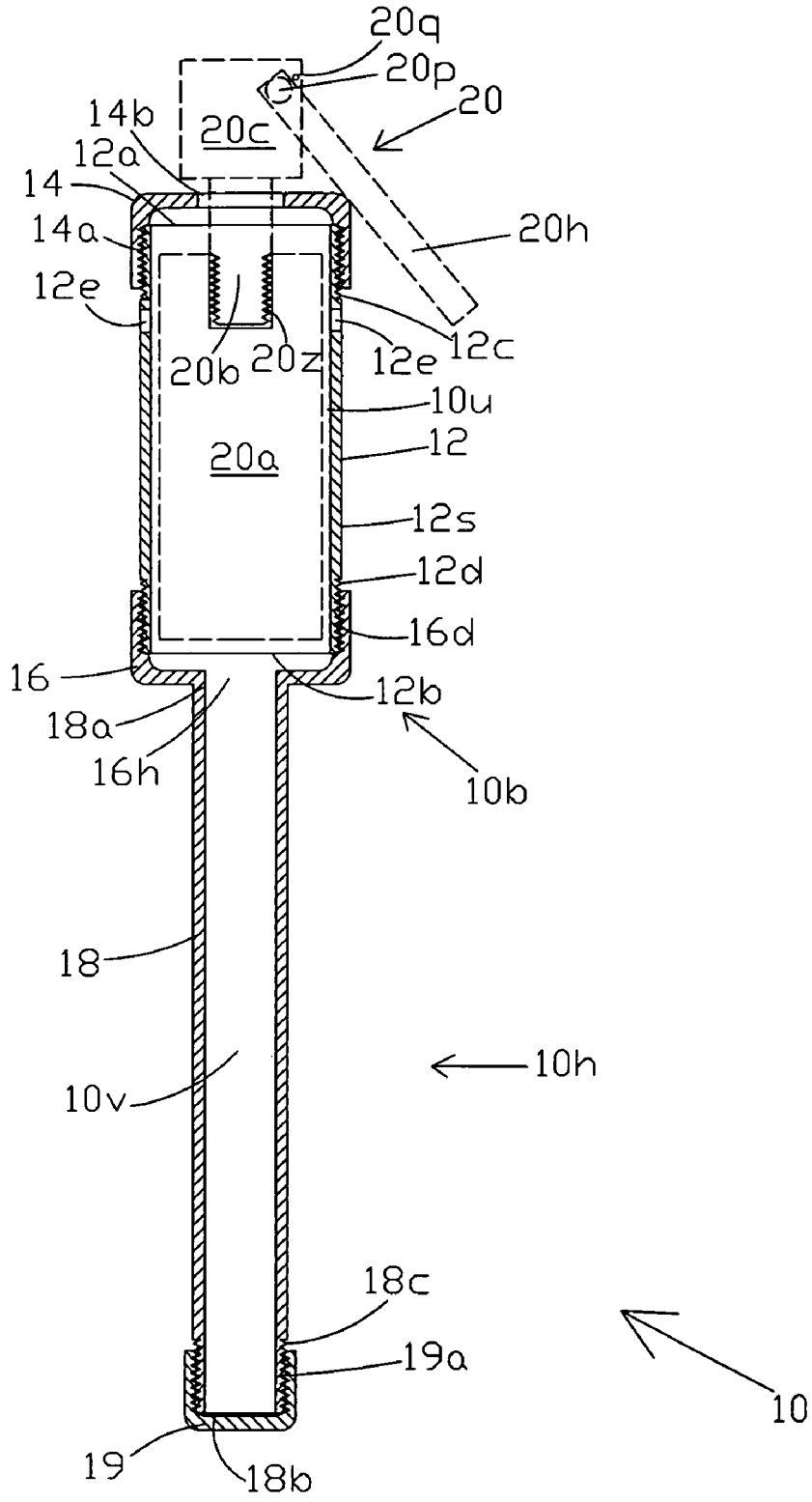
FIG. 1A is a cross-sectional representation of a first embodiment of a hand-hurled HGDD according to the present invention. The first embodiment is suitable for handling small tear-gas grenades such as the 509 ACS grenade from Federal Laboratories Inc.

Referring to FIG. 1A, HGDD 10 has a club-shaped housing, comprising a bulbous section 10*b* and a stick handle section 10*h*. Bulbous section 10*b* comprises an internal cylindrical chamber for containing the tear-gas canister. The internal chamber is shown in FIG. 1A as tear-gas canister chamber (TGCC) 12. Physically, TGCC 12 is manufactured from a short piece of steel pipe 12*s* which has ends 12*a* and 12*b*. Pipe 12*s* is dimensionally designed to receive a 509 ACS tear-gas grenade canister, shown as 20*a* in FIG. 1A, in its inner cavity. Pipe 12*s* is provided with external screw threads 12*c* and 12*d* at each of its ends 12*a* and 12*b* respectively.

The housing of bulbous section 10*b* further includes a first pipe cap 14 which has internal threads 14*a*, that mate with threads 12*c* of pipe 12*s*. Pipe cap 14 is screwed over end 12*a* of pipe 12*s*. The housing of bulbous section 10*b* further includes a second pipe cap 16 which also has internal threads 16*d*, that mate with threads 12*d* of pipe 12*s*. Pipe cap 16 is screwed over other end 12*b* of pipe 12*s*. The assembly of pipe 12*s* and caps 14 and 16 therefore defines an internal cylindrical volume 10*u* for the location of the tear-gas canister 20*a* and for the release of the tear-gas therefrom.

A plurality of tear-gas release-slots or orifices 12*e* are provided peripherally on pipe 12*s*. While FIG. 1A shows tear-gas release-slots 12*e* located proximate to screwed threads 12*c*, they could be located anywhere in bulbous section 10*b* without deviating from the spirit of the invention. An opening 14*b* is provided concentrically in the dome of cap 14 to insert, there-through, the externally-threaded projection 20*b* of bouchont 20*c* of tear gas grenade 20. Opening 14*b* is preferably circular but can be any shape as long as it is large enough for the externally-threaded projection 20*b* of bouchont 20*c* to pass through. Bouchont 20*c* contains the trigger mechanism for firing tear-gas grenade 20. As stated above, bouchont 20*c* has an externally-threaded projection 20*b*. When tear-gas grenade 20 is required to be armed for use, externally-threaded projection 20*b* is inserted through circular hole 14*b* of cap 14 and is screwed into a mating internally-threaded cavity 20*z* in tear-gas canister 20*a*.

As shown in FIG. 1A, stick-handle section 10*h* of the housing of HGDD 10 is configured from a short piece of steel pipe 18. Steel pipe 18 can be about 8 to 18 inches long or any length suitable for grasping with the average human hand. At its first end 18*a*, steel pipe 18 is welded, screwed-on, or otherwise integrally connected to second cap 16 of bulbous section 10*b*. Steel pipe 18 is provided with external-screw-threads 18*c* at its second end 18*b*. A cap 19 with internal screws 19*a* is threaded onto second end 18*b* of pipe 18 to close the second end 18*b* of pipe 18 to provide an internal volume 10*v*. Internal volume 10*v* is in fluid communication with internal volume 10*u* through a hole 16*h* in the dome of cap 16. During use of HGDD 10, the flame produced by tear-gas canister 20*a* enters volume 10*v* through hole 16*h*. The flame is contained within volume 10*v*, thereby reducing the possibility of inadvertently causing a fire while using tear-gas grenade 20.

While stick-handle section 10*h* has been shown as a hollow steel pipe 18 in FIG. 1A, a non-hollow or solid stick handle can also be used without departing from the spirit of the invention. When using a solid stick-handle, internal cylindrical chamber 12 may be further elongated to leave a hollow space between the bottom of tear-gas canister 20*a* and bottom cap 16 to contain the pyrotechnic-generated flames therein.

Further, while top cap 14 has been shown as a means of securing the tear-gas canister within HGDD 10, other securing means can also be used. For example, spring-assisted holding arms could be located within the chamber to frictionally hold the tear-gas canister in place within TGCC 12. As another example, friction-pads could be located within the chamber to hold the tear-gas canister in place within TGCC 12. In these examples, it will be obvious that the diameter of the chamber should be somewhat larger than the diameter of the canister so that the tear-gas can flow out of the top open end of the chamber through the annular space between the canister and the chamber. Accordingly, in such an arrangement, tear-gas release holes 12*e* may not be needed as the tear-gas will flow out of the top open end of the chamber. All of these variations will be obvious to one of ordinary skill in the art and are covered by the scope of the present invention.

To use HGDD 10, cap 14 is unscrewed and tear-gas canister 20*a* is inserted into volume 10*u* within pipe 12*s*. Cap 14 is then screwed back on to pipe 12*s*. Threaded projection 20*b* of bouchont 20*c* of tear-gas canister 20 is then inserted through opening 14*b* in cap 14 and is screwed into the internally-threaded-cavity 20*z* in tear-gas canister 20*a*. HGDD 10 is now ready for deployment. To deploy HGDD 10, the officer first grasps stick-handle 10*h* with his/her first hand and pulls grenade pin 20*q* on bouchont 20*c* with his/her second hand to release the firing pin. He/she then hurls HGDD 10 towards the target with his/her first hand. In a barricade situation, HGDD 10 can be hurled through a window or other opening of a building to release the tear-gas within the target area to safely flush out the barricaded law-resister from the target area.

HGDD 10 of FIG. 1A is compact, slim, lightweight (weighs only 2 pounds), and is approximately 18 inches long. These physical properties and the club-shaped configuration with the easy-to-grasp stick-handle make it easier to use than the currently used "Burn-Safe".

Figure 1B:
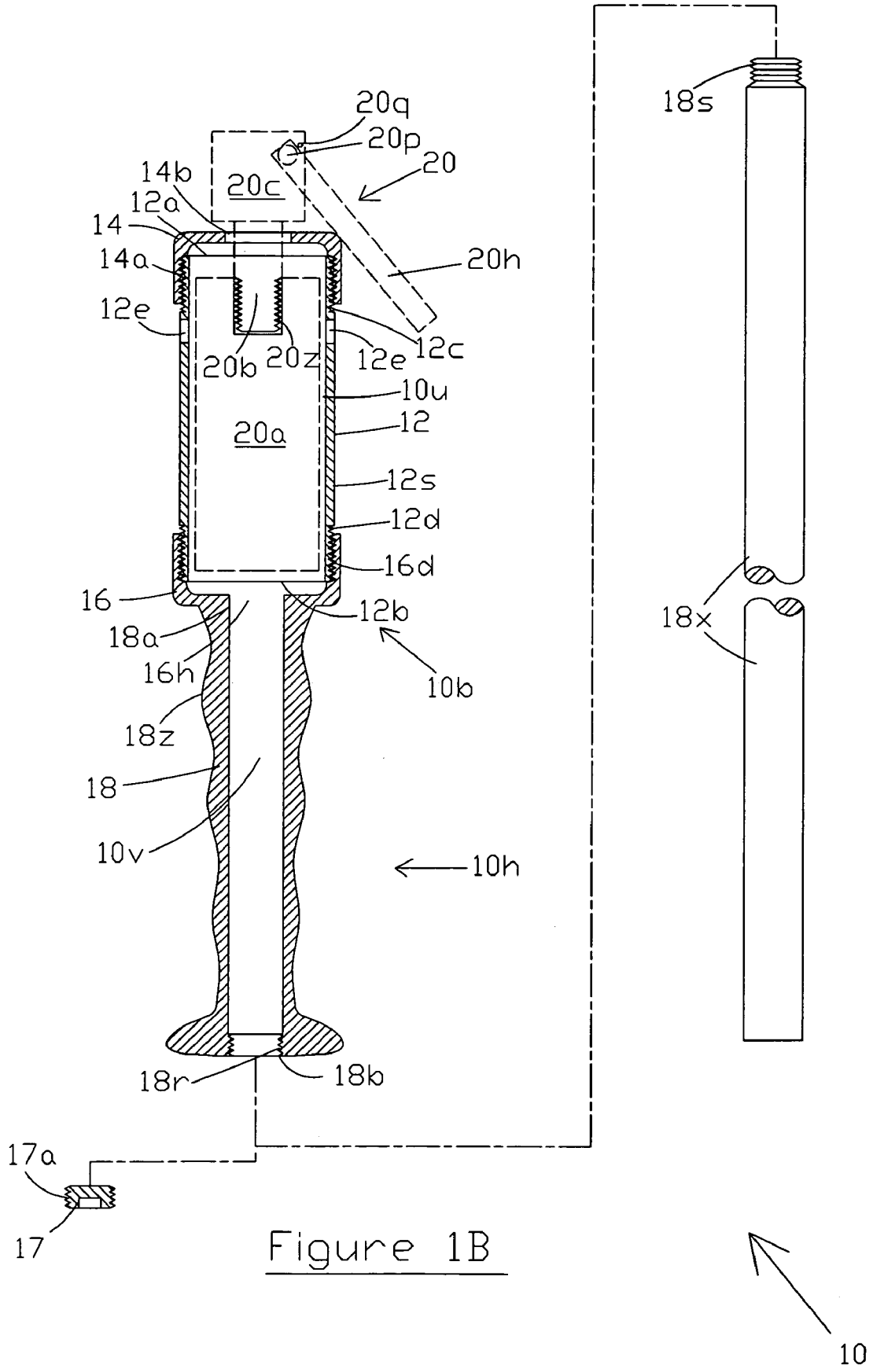
FIG. 1B is a cross-sectional representation of another aspect of the first embodiment of HGDD of FIG. 1A which is further provided with a means for attaching to an extension pole to deliver the hot-gas into hard to reach areas.

FIG. 1B shows a modification of the HGDD of FIG. 1A which is adapted to being fixed to a stick-handle extension means—for example, an extension-pole—for better access to barricaded law-resisters. In HGDD 10 of FIG. 1B, lower cap 16 and handle 18 are fabricated as a single hollow piece. Further, the handle 18 of this embodiment is fabricated with an easy-to-grasp curvilinear surface 18*z* to fit within the fist of the law-enforcement officer. The cap 19 is replaced by a hexagonal sunk-screw 17 whose external threads 17*a* engage mating threads 18*r* in the lower end 18*b* of handle 18.

Extension-pole 18*x* is about 5 feet long but it could be longer, up to 20 feet long. Extension-pole 18*x* has threads 18*s* at one end which mate with threads 18*r* in the lower end 18*b* of handle 18.

When HGDD 10 of FIG. 1B is to be used in hard-to-access spaces, sunk-screw 17 is removed and extension-pole 18*x* is threaded into lower end 18*b* of handle 18. Tear-gas grenade 20 is then activated as described previously. The activated HGDD 10 is then inserted into the barricaded space to safely flush out the barricaded law-resister.

Second Embodiment of the Invention

Figure 2:
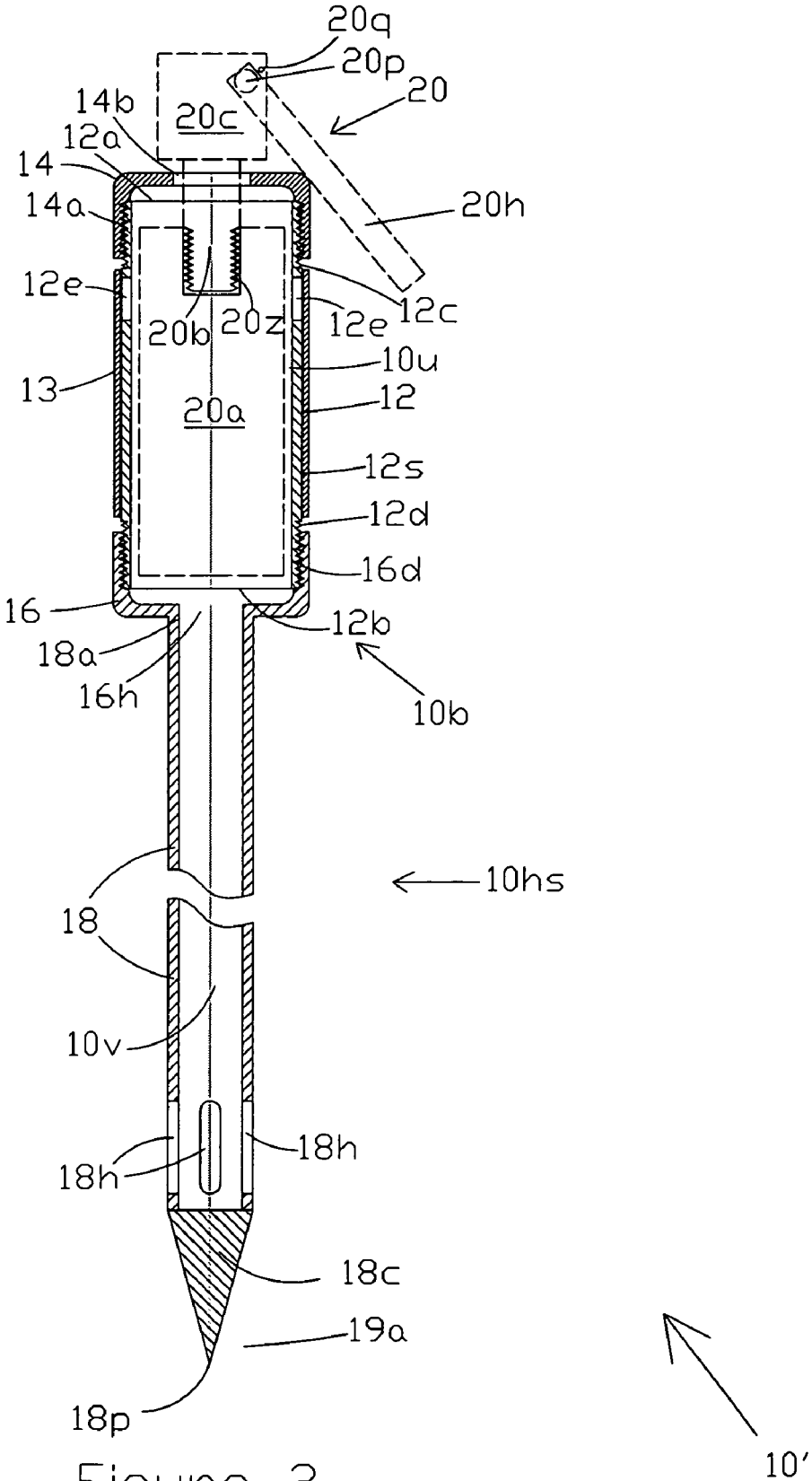
FIG. 2 is a cross-sectional representation of a second embodiment of a spiked HGDD according to the present invention. The second embodiment is suitable for handling small tear-gas grenades and is used to inject the tear gas into an enclosed space by penetrating the wall or roof or ceiling or other barricade obstructions of the enclosed space.

FIG. 2 shows a second embodiment of the HGDD of the present invention which is designed for penetrating through the building wall or ceiling or roof to release the tear-gas into the building space to flush out the barricaded law-resister therefrom.

As shown in FIG. 2, HGDD 10' has a bulbous end 10*b* which is identical to the bulbous end 10*b* of HGDD 10 of FIG. 1. However, in this embodiment, during normal operation, the tear-gas is released through openings in tubular section 10*hs* rather than through bulbous section 10*b*, as will be described later. A cylindrical sleeve 13 of a pressure-distensible flexible material such as rubber or other such elastic material is fitted over TGCC 12 to cover tear-gas release openings 12*e*. The pressure-distensible flexible material used could be rubber or any other such elastic material which will be obvious to one skilled in the art. In practice, cylindrical sleeve 13 has been satisfactorily configured from a short piece of bicycle-tire inner-tubing. If the normal tear-gas release orifices 18*h* of HGDD 10' get blocked during use of HGDD 10', the higher gas pressure within volume 10*u* distends cylindrical sleeve 13 to release the excess gas pressure within volume 10*u* for additional safety during the use of HGDD 10'. Yet other means of relieving gas pressure from within HGDD 10' will be obvious to persons skilled in the art. For example, a spring-loaded pressure-relief valve, a cork held in place by friction, a rupture-disk, or other means of releasing gas pressure from within a confined space can also be used without deviating from the spirit of the invention.

HGDD 10' also has a stick-handle 10*hs* which is similar to the stick-handle 10*h* of HGDD 10 of FIG. 1 except for the following differences:

1) Steel pipe 18 of stick-handle 10*hs* of HGDD 10' is much longer, preferably between 24 to 48 inches long but even as long as 10 feet, than steel pipe 18 of stick-handle 10*h* of HGDD 10. The longer length allows for the deeper penetration of stick-handle 10*hs* into walls or roofs or other barricade obstructions for releasing the tear-gas into spaces enclosed by these obstructions.
2) The free end of steel pipe 18 of stick-handle 10*hs* is welded or otherwise integrally attached to a barricade penetration means such as spear-cone 18*c*. The sharp spear-point 18*p* of spear-cone 18*c* facilitates the penetration of steel pipe 18 through walls and roofs during the use of HGDD 10'. As an alternate arrangement, instead of the separate spear-cone shown in FIG. 2, pipe 18 could be squeezed or hammered and machined to form sharp spear-point 18*p* of the barricade penetration means. As yet another alternate arrangement, barricade penetration means could be configured with a drill-bit for penetrating hard impediments such as brick or concrete walls.
3) Tear-gas release holes 18*h* are provided proximate spear-cone 18*c* for releasing the tear-gas into the enclosed space during the use of HGDD 10'. Thus steel pipe 18 functions as a tear-gas delivery flow channel for delivering the tear-gas from HGDD 10' into the targeted space. Alternately, the tear-gas release holes 18*h* can also be provided in cone 18*c* or in both stick handle 10*hs* and in cone 18*c*.

During deployment, HGDD 10' is armed with tear-gas grenade 20 as described previously for HGDD 10. Instead of HGDD 10' being hurled, as described previously with respect to HGDD 10 of FIG. 1A, the pointed spear-cone 18*c* of HGDD 10 is spiked through the wall, roof, or other barricade obstruction. Tear-gas grenade 20 is then fired by pulling the firing pin 20*q*. Tear-gas is first released into volume 10*u*. As tear-gas release holes 12*e* in TGCC 12 are blocked by cylindrical sleeve 13, the tear-gas escapes into volume 10*v* though hole 16*h* in lower cap 16. The tear-gas fills up volume 10*v* and is released into the barricaded space behind the wall through tear-gas release holes 18*h*. If, for some reason, release holes 18*h* are blocked to obstruct the release of the tear-gas, the high gas-pressure within volume 10*u* causes cylindrical sleeve 13 to distend to open tear-gas release holes 12*e*. The tear-gas in volume 10*u* then escapes through tear-gas release holes 12*e*, thereby preventing potentially dangerous build-up of gas-pressure within volume 10*u*.

Third Embodiment of the Invention

Figure 3A:
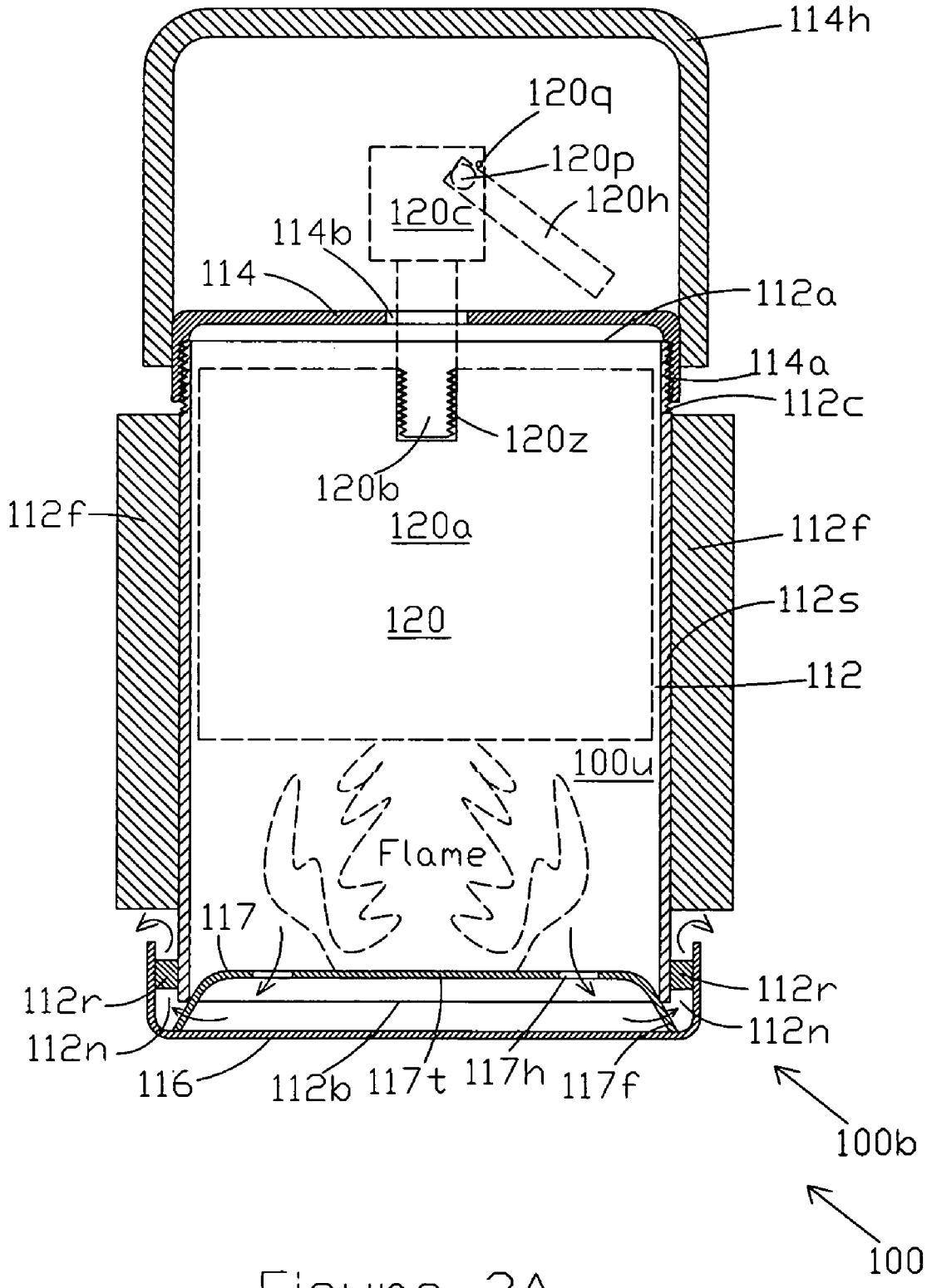
FIG. 3A is a cross-sectional representation of a third embodiment of a hand-hurled HGDD according to the present invention. This HGDD is suitable for handling larger tear-gas grenades such as the 509 ACS grenade from Federal Laboratories Inc.

FIG. 3A shows a third embodiment of the HGDD of the present invention which is designed for deploying larger tear-gas grenades such as the 555 ACS from Federal Laboratories Inc.

As shown in FIG. 3A, HGDD 100 has a housing 100*b* which has an internal cylindrical chamber, shown as TGCC 112. TGCC 112 is configured from a large-diameter steel pipe 112*s* which is dimensionally designed to receive the 555 ACS tear-gas grenade. Housing 100*b* also includes a cap-closure 114 which has internal threads 114*a* that engage mating external-threads 112*c* on the first end 112*a* of pipe 112*s*. Cap closure 114 is screwed onto first end 112*a* of pipe 112*s*. Further, cap closure 114 has a concentric hole 114*b* to allow for the insertion of threaded projection 120*b* of tear-gas grenade 120, as described previously with respect to HGDD 10 of FIG. 1A. A metal handle 114*h*, which is similar to a bucket-handle, is screwed or otherwise attached on to the dome of cap 114 to enable the user to transport and hurl HGDD 100.

While cap-closure 114 has been shown and described with threads for attachment to pipe 112*s*, other forms of attachments could also be used without deviating from the spirit of the invention. For example, latches could be used to attach cap-closure 114 to pipe 112*s*. Further, bucket handle 114*h* could also be attached to steel pipe 112*s* without deviating from the spirit of the invention.

At its second end, radially-oriented spacers 112*r* are welded on the outer periphery of pipe 112*s*. An unthreaded, oversized cap 116 is welded to the free ends of spacers 112*r* to form the generally closed end of TGCC 112. The annular gap 112*n* between the outer diameter of pipe 112*s* and the inner diameter of cap 116 provides a flow passage for the release of the tear-gas from volume 100*u* in TGCC 112. Alternately, cap 116 can be dimensionally configured to fit over radial fins 112*f* (described below) to provide the annular gap.

Radial fins 112*f* are provided peripherally along the longitudinal length of pipe 112*s* between external threads 112*c* and spacers 112*r*. During deployment of HGDD 100, fins 112*f* dissipate the heat from the hot steel pipe 112*s*. Fins 112*f* also provide a thermal stand-off means between hot steel pipe 112*s* and flammable materials in the target area, thereby reducing the possibility of conflagrations in the target area. Radial fins 112*f* also enhance the weight of HGDD 100 to provide it greater momentum to crash through barricades. Other means of enhancing the weight of the HGDD and for providing the thermal stand-off means could also be used. For example, steel tube 112*s* could have thicker walls to provide more weight and therefore more momentum to HGDD 100. Further, pipe 112*s* could be wrapped with a refractory or thermal insulation material as an alternate thermal stand-off means.

Figure 3B:
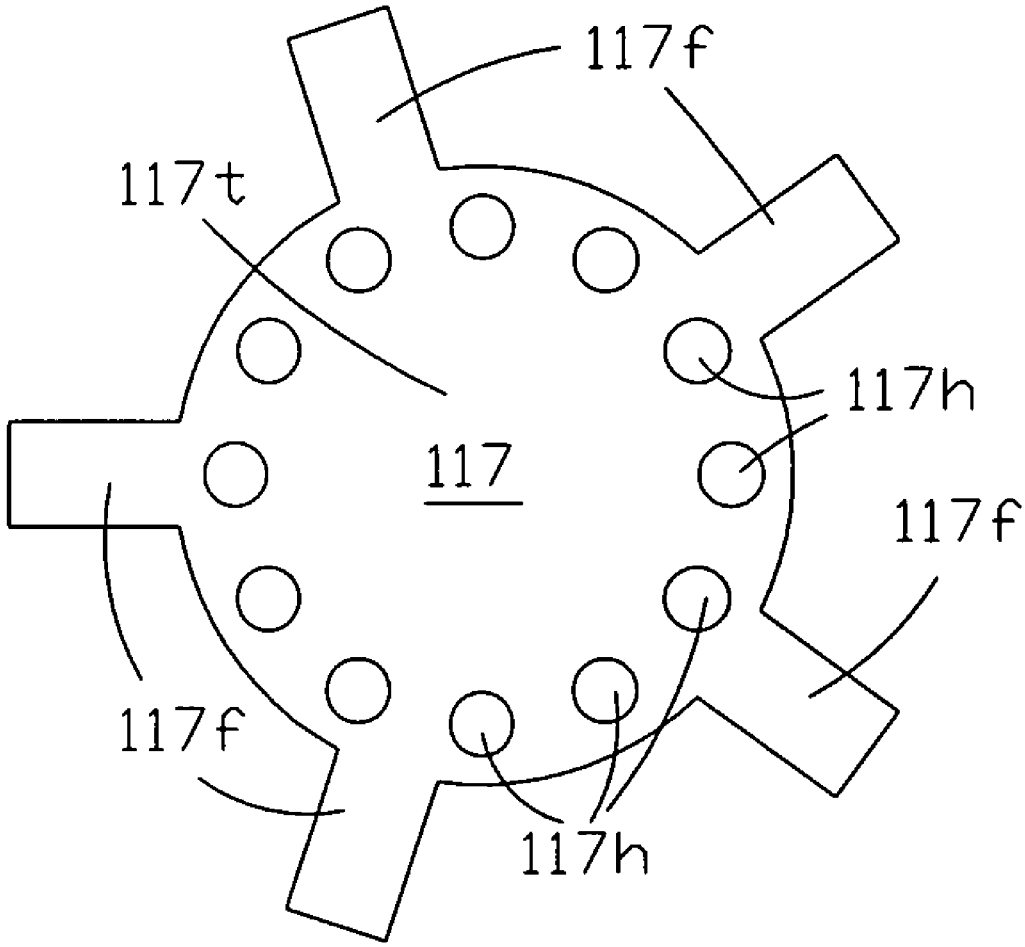
FIG. 3B is a plan representation of the flame-impingement baffle used in the HGDD of FIG. 3A.

A flame-impingement baffle 117 is provided within internal volume 112*u* to deflect the flame generated by the tear-gas canister back into the internal volume 112*u*. Thus, as shown in FIG. 3A, the flame is contained within HGDD 100, further reducing the possibility of accidentally starting a fire in the target area. As shown in the plan-representation of FIG. 3B, baffle 117 is fabricated from a relatively thin, but somewhat springy, sheet of stainless steel. For example, a 24-gauge stainless steel sheet can be used for fabricating baffle 117. As shown in FIG. 3B, baffle 117 is configured with a central target area 117*t* which has a diameter less than the internal diameter of steel tube 112*s*. Radial fingers 117*f* are provided around the circumference of target area 117*t*. The length of radial fingers 117*f* is such that when installed, target area 117*t* is supported approximately 1.5 inches from the internal surface of bottom cap-closure 116 of HGDD 100. During installation of baffle 117, radial fingers 117*f* are bent downwards and baffle 117 is inserted within tube 112*s* until the tips of radial fingers 117*f* contact the inside surface of cap-closure 116. Baffle 117 is held in place by the springiness of fingers 117*f* against the inside surface of tube 112*s*. Tear-gas flow holes 117*h* are provided radially in the circumference zone of target area 117*t* to allow the tear-gas (represented by arrows in FIG. 3A) to flow from internal volume 112*u* while containing the flame within internal volume 112*u*. The tear-gas flows past baffle 117 through holes 117*h* and then through the space between fingers 117*f* into annular space 112*n*, and then past radial spacers 112*r* into the external environment of HGDD 100. Yet other designs and means of providing a flame-impingement baffle will be obvious to one of ordinary skill in the art.

For deployment, HGDD 100 is armed with tear-gas grenade 120 by unscrewing top cap 114 from pipe 112*s*, inserting tear-gas canister 120*a* into internal volume 112*u*, screwing top cap 114 back on to pipe 112*s*, inserting threaded projection 120*b* of tear-gas grenade 120 into opening 114*b*, and screwing threaded projection 120*b* into threaded cavity 120*z* of tear-gas canister 120*a*. To deploy HGDD 100, the officer first grasps handle 114*h* with his/her first hand and pulls the grenade pin 120*q* on bouchont 120*c* with his/her second hand to release the firing pin. He/she then hurls HGDD 100 towards the target with his/her first hand. In a barricade situation, HGDD 100 can be hurled through a window or other opening of a building to release the tear-gas within the target area to safely flush out the barricaded law-resister from his/her barricaded space.

Fourth Embodiment of the Invention

Figure 4A:
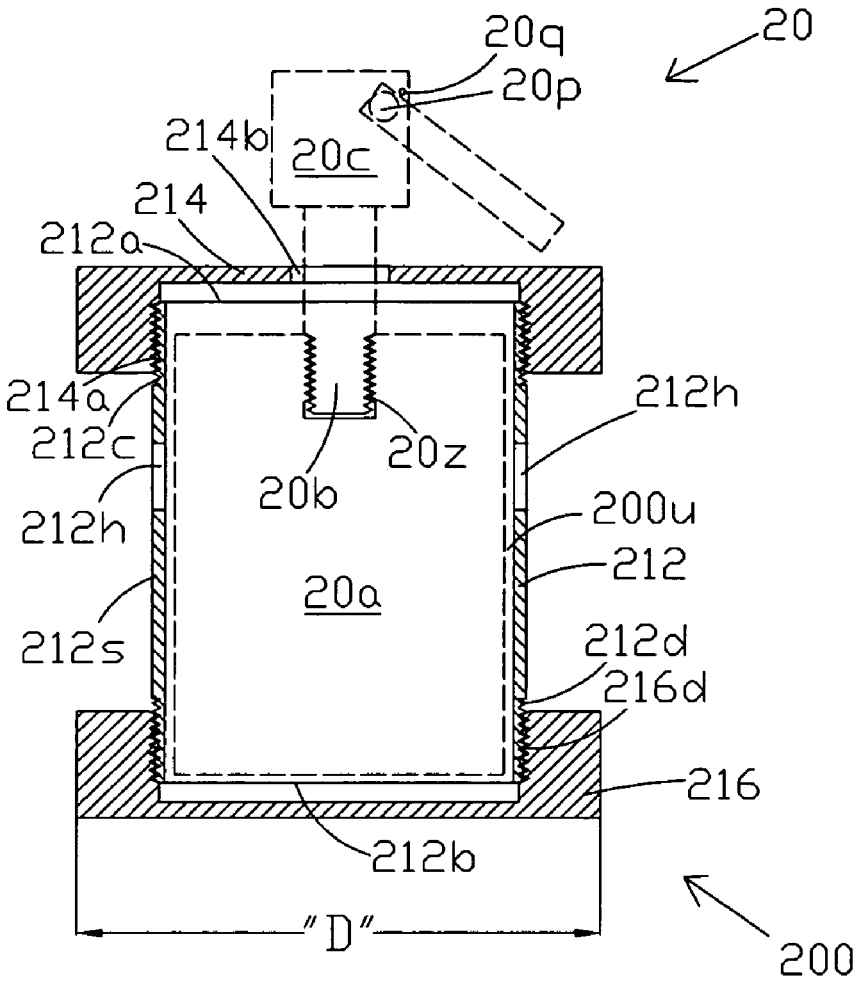
FIG. 4A is a cross-sectional representation of a fourth embodiment of a HGDD, according to the present invention, which can be propelled by a shotgun assisted tear-gas grenade launcher. This HGDD is suitable for use with smaller tear-gas grenades.

FIG. 4A shows a fourth embodiment of the HGDD of the present invention, which is designed for use with a shotgun-assisted tear-gas grenade launcher. This embodiment is used to deploy smaller tear-gas grenades such as the 509 ACS from Federal Laboratories Inc.

Figure 4B:
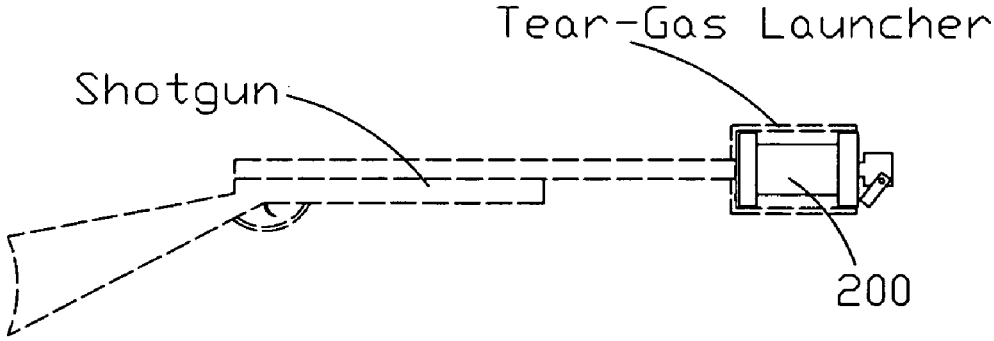
FIG. 4B is a representation of the use of embodiment of HGDD 200 of FIG. 4A with a shotgun-assisted tear-gas launcher.

FIG. 4B shows HGDD 200 of FIG. 4A being used with a shotgun-assisted tear-gas launcher, for example, the tear-gas launcher marketed by Federal Laboratories Inc.

As shown in FIG. 4A, HGDD 200 comprises a housing that defines TGCC 212 which is dimensionally configured to receive the 509 ACS tear-gas grenade. A plurality of tear-gas release holes 212*h* are provided radially in TGCC 212 for releasing the tear-gas from internal volume 200*u* of TGCC 212.

As described previously for HGDD 10 of FIG. 1A, TGCC 212 is assembled using a cylindrical pipe 212*s*, a top cap-closure 214 and a bottom cap-closure 216. Cylindrical pipe 212*s* has a first threaded end 212*a* with external screw-threads 212*c* and a second threaded end 212*b* with external screw-threads 212*d*. Cap closure 216 has mating internal threads 216*d* and is screwed onto the second end 212*b* of pipe 212*s*. Cap closure 214 has mating internal threads 214*a* and is screwed onto the first end 212*a* of pipe 112*s*. Cap enclosure 214 has a concentric circular opening 214*b* in its upper dome to receive the threaded projection 20*b* of bouchont 20*c* of tear-gas grenade 20, as described previously. A plurality of tear-gas release holes 212*h* are provided radially in pipe 112*s* for releasing the tear-gas from internal volume 200*u* of TGCC 212. Caps 214 and 216 are diametrically configured with outside diameters "D" to snugly and slidingly fit within the breech of the cylindrical launch-chamber of a tear-gas grenade launcher, for example, the tear-gas launcher from Federal Laboratories.

HGDD 200 can be made of a light metal such as aluminum or titanium but is preferably made of a high-temperature resistant plastic (for example, Delrin®) or other non-metallic material to provide a lightweight, inexpensive, and disposable design.

For deployment, HGDD 200 is armed with tear-gas grenade 20 by unscrewing top cap 214 from pipe 112*s*, inserting tear-gas canister 20*a* into internal volume 200*u* of TGCC 212, screwing top cap 214 back on to pipe 112*s*, inserting threaded projection 20*b* of bouchont 20*c* into opening 214*b*, and screwing threaded projection 20*b* into threaded cavity 20*z* of tear-gas canister 20*a*. As shown in FIG. 4B, armed HGDD 200 is then inserted into the breech of the launch chamber of the tear-gas launcher which is attached to a shotgun loaded with a smoke shell. When ready to launch, the pin 20*q* is removed to trigger grenade 20 and the shotgun is fired to propel HGDD 200 to a great distance. The propelled distance depends on the launch-pressure generation capacity of the smoke shell. For standard smoke shells, it is generally in the range of 50 to 100 yards.

While preferred embodiments of the present invention have been shown and described herein, it will be obvious that such embodiments are provided by way of example only. Numerous variations, changes, and substitutions will occur to those skilled in the art without departing from the invention herein. Accordingly, it is intended that the invention be limited only by the spirit and scope of the forthcoming claims.

We claim:

1. A hot gas deployment device for safely discharging a hot tear-gas grenade, the device comprising:

a housing defining an internal chamber for axially receiving a tear-gas canister, the chamber being open at one end and generally closed at its second end, the housing further formed with a handle for grasping the hot gas deployment device during deployment and securing means for generally holding the tear-gas canister in position within the chamber during the deployment of the tear-gas grenade, wherein the handle is a hollow stick-handle which is formed on the closed end of the housing and comprising a barrier penetration means and an orifice for releasing the tear-gas inside the barricaded space, the housing further comprising a tear-gas release orifice in the housing for releasing the tear-gas from within the chamber to the external environment of the chamber, the housing further comprising a tear-gas pressure relief means for releasing the tear-gas from the internal chamber if excessive gas pressure builds up in the internal chamber, wherein the tear-gas pressure relief means is a pressure-distensible flexible sleeve, the flexible sleeve being sleeved over the external surface of the housing to cover the tear-gas release orifice on the housing.

2. The hot gas deployment device of claim 1, wherein the stick-handle has a length between 2 to 10 feet.

3. The hot gas deployment device of claim 1 wherein the securing means comprises a cap-closure for the open end of the chamber.

4. The hot gas deployment device of claim 3 wherein the cap-closure has an opening for inserting the threaded end of the bouchont of the tear-gas grenade.

5. The hot gas deployment device of claim 4 wherein the stick-handle has a length between 2 to 10 feet.

6. A hot gas deployment device for safely discharging a hot tear-gas grenade, the device comprising:

a housing defining an internal chamber for axially receiving a tear-gas canister, the chamber being open at one end and generally closed at its second end, the housing further formed with a handle for grasping the hot gas deployment device during deployment and securing means for generally holding the tear-gas canister in position within the chamber during the deployment of the tear-gas grenade, and wherein the housing comprises a cap-closure for the open end of the chamber, the cap-closure having an opening for inserting the threaded end of the bouchont of the tear-gas grenade, the cap-closure further functioning as the securing means for generally holding the tear-gas canister in position within the chamber during the deployment of the tear-gas grenade, the housing further including a first tear-gas release orifice in the housing for releasing the tear-gas from within the chamber to the external environment of the chamber, the housing further comprising a tear-gas pressure relief means for the first tear-gas release orifice for releasing the tear-gas from the internal chamber if excessive gas pressure builds up in the internal chamber, wherein the tear-gas pressure relief means is a pressure-distensible flexible sleeve, the flexible sleeve being sleeved over the external surface of the housing to cover the tear-gas release orifice on the housing.

7. The hot gas deployment device of claim 6 wherein the handle is a stick handle.

8. The hot gas deployment device of claim 7 wherein the stick-handle is hollow.

9. The hot gas deployment device of claim 8 wherein the free end of the stick-handle has a removable closure means.

10. The hot gas deployment device of claim 9 wherein the free end of the stick-handle has internal threads and the removable closure means is a plug with external threads that mate with the internal threads of the free end of the stick-handle.

11. The hot gas deployment device of claim 10 further comprising an extension pipe, the extension pipe having external threads that mate with the internal threads of the free end of the stick-handle.

12. The hot gas deployment device of claim 11 wherein the extension pipe comprises a barrier penetration means and an orifice for releasing the tear-gas inside the barricaded space.

13. The hot gas deployment device of claim 8 further comprising an extension pipe and means to attach the extension pipe to the free end of the stick-handle.

14. The hot gas deployment device of claim 13 wherein the extension pipe comprises a barrier penetration means and an orifice for releasing the tear-gas inside the barricaded space.

15. A hot gas deployment device for safely discharging a hot tear-gas grenade, the device comprising:

a housing defining an internal chamber for axially receiving a tear-gas canister, the chamber being open at one end and generally closed at its second end, the housing further formed with a handle for grasping the hot gas deployment device during deployment and securing means for generally holding the tear-gas canister in position within the chamber during the deployment of the tear-gas grenade, the housing further including a first tear-gas release orifice in the housing for releasing the tear-gas from within the chamber to the external environment of the chamber, the housing further comprising a tear-gas pressure relief means for the first tear-gas release orifice for releasing the tear-gas from the internal chamber if excessive gas pressure builds up in the internal chamber, wherein the tear-gas pressure relief means is a pressure-distensible flexible sleeve, the flexible sleeve being sleeved over the external surface of the housing to cover the tear-gas release orifice on the housing.

16. The hot gas deployment device of claim 15, wherein the handle is a hollow stick-handle.

17. The hot gas deployment device of claim 16 further comprising an extension pipe and means to attach the extension pipe to the free end of the stick-handle.

18. The hot gas deployment device of claim 17 wherein the extension pipe comprises a barrier penetration means and an orifice for releasing the tear-gas inside the barricaded space.

19. The hot gas deployment device of claim 15 wherein the securing means comprises a cap-closure for the open end of the chamber.

20. The hot gas deployment device of claim 19 wherein the cap-closure has an opening for inserting the threaded end of the bouchont of the tear-gas grenade.

* * * * *